US012070100B2

(12) United States Patent
Toronjo

(10) Patent No.: US 12,070,100 B2
(45) **Date of Patent: *Aug. 27, 2024**

(54) LAMINATE PANEL WITH AUXETIC LAYER

(71) Applicant: Under Armour, Inc., Baltimore, MD (US)

(72) Inventor: Alan Toronjo, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 256 days.

This patent is subject to a terminal disclaimer.

(21) Appl. No.: 17/369,918

(22) Filed: Jul. 7, 2021

(65) Prior Publication Data

US 2021/0401119 A1 Dec. 30, 2021

Related U.S. Application Data

(63) Continuation of application No. 15/980,263, filed on May 15, 2018, now abandoned, and a continuation-in-part of application No. 16/551,397, filed on Aug. 26, 2019, now Pat. No. 11,185,128, which is a continuation of application No. 15/436,499, filed on Feb. 17, 2017, now Pat. No. 10,426,226, which is a continuation-in-part of application No. 15/386,975, filed on Dec. 21, 2016, now Pat. No. 9,949,518, which is a continuation of (Continued)

(51) Int. Cl.

| | |
|---|---|
| ***B32B 3/24*** | (2006.01) |
| ***A43B 1/02*** | (2022.01) |
| ***A43B 1/04*** | (2022.01) |
| ***A43B 23/02*** | (2006.01) |

(52) U.S. Cl.

CPC ..... *A43B 23/026* (2013.01); *A43B 1/02* (2013.01); *A43B 1/04* (2013.01); *A43B 23/0235* (2013.01); *A43B 23/0255* (2013.01); *A43B 23/0265* (2013.01); *A43B 23/024* (2013.01)

(58) Field of Classification Search

CPC ..... B32B 3/266

See application file for complete search history.

(56) References Cited

U.S. PATENT DOCUMENTS

| | | | |
|---|---|---|---|
| 4,668,557 | A | 5/1987 | Lakes |
| 4,809,690 | A | 3/1989 | Bouyssi |

(Continued)

FOREIGN PATENT DOCUMENTS

| | | |
|---|---|---|
| FR | 2876879 | 4/2006 |
| JP | 10072719 A | 3/1998 |

(Continued)

OTHER PUBLICATIONS

European Search Report from EU Application No. 13179068, issued Nov. 20, 2013.

*Primary Examiner* — William P Watkins, III

(74) *Attorney, Agent, or Firm* — Maginot, Moore & Beck, LLP

(57) ABSTRACT

An article of apparel includes a first layer and a second layer. An auxetic structure penetrates the first layer. The auxetic structure includes a plurality of interconnected members forming an array of cell units. Each of the plurality of interconnected members form cell walls with interior recesses defined within the cell walls. The second layer is coupled to the first layer via the auxetic structure.

20 Claims, 7 Drawing Sheets

Related U.S. Application Data application No. 14/137,038, filed on Dec. 20, 2013, now Pat. No. 9,538,798, which is a continuation-in-part of application No. 13/838,827, filed on Mar. 15, 2013, now Pat. No. 9,629,397, application No. 17/369,918, filed on Jul. 7, 2021 is a continuation-in-part of application No. 16/267,417, filed on Feb. 5, 2019, now Pat. No. 11,266,191, which is a continuation of application No. 15/459,952, filed on Mar. 15, 2017, now Pat. No. 10,195,815, which is a continuation of application No. 13/838,827, filed on Mar. 15, 2013, now Pat. No. 9,629,397, application No. 17/369,918, filed on Jul. 7, 2021 is a continuation-in-part of application No. 15/918,629, filed on Mar. 12, 2018, now Pat. No. 11,109,629, which is a continuation of application No. 14/137,250, filed on Dec. 20, 2013, now Pat. No. 9,936,755, which is a continuation-in-part of application No. 13/838,827, filed on Mar. 15, 2013, now Pat. No. 9,629,397.

(60) Provisional application No. 62/506,127, filed on May 15, 2017, provisional application No. 61/695,993, filed on Aug. 31, 2012.

(56) References Cited

U.S. PATENT DOCUMENTS

| | | | |
|---|---|---|---|
| 5,334,903 | A | 8/1994 | Smith |
| 5,661,854 | A | 9/1997 | March |
| 5,937,441 | A | 8/1999 | Raines |
| 6,029,376 | A | 2/2000 | Cass |
| 6,247,181 | B1 | 6/2001 | Hirsch |
| 6,539,556 | B1 | 4/2003 | Barker |
| 6,783,814 | B2 | 8/2004 | Swager |
| 6,878,320 | B1 | 4/2005 | Alderson |
| 6,989,075 | B1 | 1/2006 | Kao |
| D521,191 | S | 5/2006 | Berger |
| 7,160,621 | B2 | 1/2007 | Chaudhari |
| 7,247,265 | B2 | 7/2007 | Alderson |
| 7,252,870 | B2 | 8/2007 | Anderson |
| 7,350,851 | B2 | 4/2008 | Barvosa-Carter |
| 7,455,567 | B2 | 11/2008 | Bentham et al. |
| 7,650,648 | B2 | 1/2010 | Roberts |
| 7,858,055 | B2 | 6/2010 | Lee |
| 7,824,763 | B2 | 11/2010 | Namburi |
| 7,896,294 | B2 | 3/2011 | Dittrich |
| 7,910,193 | B2 | 3/2011 | Ma |
| 7,989,057 | B2 | 8/2011 | Alderson |
| 8,074,418 | B2 | 12/2011 | Thiagarajan |
| 8,084,117 | B2 | 12/2011 | Lalvani |
| 8,304,355 | B2 | 11/2012 | Baldauf |
| 8,436,508 | B2 | 5/2013 | Kombluh |
| 9,538,798 | B2 | 1/2017 | Toronjo |
| 9,629,397 | B2 | 4/2017 | Toronjo |
| 9,936,755 | B2 | 4/2018 | Blakely |
| 11,266,191 | B2 * | 3/2022 | Toronjo ..... B32B 27/08 |
| 2002/0132543 | A1 | 9/2002 | Baer |
| 2005/0035031 | A1 | 2/2005 | Alderson |
| 2005/0159066 | A1 | 7/2005 | Alderson |
| 2006/0112599 | A1 | 6/2006 | Braynock |
| 2006/0129227 | A1 | 6/2006 | Hengelmolen |
| 2007/0031667 | A1 | 2/2007 | Hook |
| 2007/0093768 | A1 | 4/2007 | Roe |
| 2007/0213838 | A1 | 9/2007 | Hengelmolen |
| 2007/0286987 | A1 | 12/2007 | Anderson |
| 2008/0011021 | A1 | 1/2008 | Starbuck |
| 2008/0032598 | A1 | 2/2008 | Bentham |
| 2008/0248710 | A1 | 10/2008 | Wittner |
| 2009/0041978 | A1 | 2/2009 | Sogard |
| 2009/0119820 | A1 | 5/2009 | Bentham |
| 2009/0239049 | A1 | 9/2009 | Hook |
| 2009/0265839 | A1 | 10/2009 | Young |
| 2010/0029796 | A1 | 2/2010 | Alderson |
| 2010/0107317 | A1 | 5/2010 | Wang |
| 2010/0305535 | A1 | 12/2010 | Leeming |
| 2010/0306904 | A1 | 12/2010 | Neid |
| 2011/0029063 | A1 | 2/2011 | Ma |
| 2011/0039088 | A1 | 2/2011 | Lee |
| 2011/0046715 | A1 | 2/2011 | Ugbolue |
| 2011/0059291 | A1 | 3/2011 | Boyce |
| 2011/0144417 | A1 | 6/2011 | Jagger |
| 2011/0155137 | A1 | 6/2011 | Martin |
| 2011/0156314 | A1 | 6/2011 | Alberg |
| 2011/0159758 | A1 | 6/2011 | Martin |
| 2011/0168313 | A1 | 7/2011 | Ma et al. |
| 2011/0209557 | A1 | 9/2011 | Burns |
| 2011/0214560 | A1 | 9/2011 | Skertchly |
| 2011/0236519 | A1 | 9/2011 | Skertchly |
| 2011/0247240 | A1 | 10/2011 | Eder |
| 2011/0250383 | A1 | 10/2011 | Summers |
| 2011/0252544 | A1 | 10/2011 | Abernethy |
| 2011/0265714 | A1 | 11/2011 | Lee |
| 2011/0281481 | A1 | 11/2011 | Alderson |
| 2011/0282452 | A1 | 11/2011 | Koerner |
| 2012/0029537 | A1 | 2/2012 | Mortarino |
| 2012/0055187 | A1 | 3/2012 | Raines |
| 2012/0060991 | A1 | 3/2012 | Mun |
| 2012/0066820 | A1 | 3/2012 | Fresco |
| 2012/0129416 | A1 | 5/2012 | Anand |
| 2012/0297643 | A1 | 11/2012 | Shaffer |
| 2013/0071583 | A1 | 3/2013 | Evans |
| 2013/0134992 | A1 | 5/2013 | Zhu |
| 2015/0050460 | A1 | 2/2015 | Fujisawa |
| 2016/0172661 | A1 | 6/2016 | Nonogawa |
| 2017/0156443 | A1 | 6/2017 | Guyan |

FOREIGN PATENT DOCUMENTS

| | | |
|---|---|---|
| JP | 2007138320 A | 6/2007 |
| WO | 2010082537 S1 | 7/2010 |
| WO | 2012069787 | 5/2012 |

* cited by examiner

LAMINATE PANEL WITH AUXETIC LAYER

CROSS-REFERENCE TO RELATED APPLICATIONS

This application is a continuation of U.S. patent application Ser. No. 15/980,263, filed May 15, 2018, which claims priority from U.S. Provisional Patent Application No. 62/506,127, filed May 15, 2017; this application is also a continuation-in-part of U.S. patent application Ser. No. 16/267,417, filed Feb. 5, 2019, which is a continuation of U.S. patent application Ser. No. 15/459,952, filed Mar. 15, 2017, which is a continuation of U.S. patent application Ser. No. 13/838,827, filed Mar. 15, 2013, which claims priority from U.S. Provisional Patent Application No. 61/695,993, filed Aug. 31, 2012; this application is also a continuation-in-part of U.S. patent application Ser. No. 15/918,629, filed Mar. 12, 2018, which is a continuation of U.S. patent application Ser. No. 14/137,250, filed Dec. 20, 2013, which is a continuation-in-part of U.S. patent application Ser. No. 13/838,827, filed Mar. 15, 2013; the disclosures of all of the foregoing applications are incorporated herein by reference in their entirety; this application is also a continuation-in-part of U.S. patent application Ser. No. 16/551,397, filed Aug. 26, 2019, which is a continuation of U.S. patent application Ser. No. 15/436,499, filed Feb. 17, 2017, which is a continuation-in-part of U.S. patent application Ser. No. 15/386,975, filed Dec. 21, 2016, which is a continuation of U.S. patent application Ser. No. 14/137,038, filed Dec. 20, 2013, which is a continuation-in-part of U.S. patent application Ser. No. 13/838,827, filed Mar. 15, 2013, which claims priority from U.S. Provisional Patent Application No. 61/695,993, filed Aug. 31, 2012.

FIELD

This document relates to the field of apparel, including footwear, and structures for incorporation into the articles of apparel.

BACKGROUND

When forming articles of apparel such as shirts, pants, and shoes, apparel manufacturers consider the fit of the apparel. Many garments and other articles of apparel are designed to fit closely to the human body. When designing an article of apparel for a close fit to the human body, different body shapes and sizes must be considered. Different individuals within a particular garment size will have different body shapes and sizes. For example, two individuals wearing the same shoe size may have very differently shaped feet, including very different heel, midfoot and forefoot dimensions. These variable measurements between similarly sized individuals makes proper design of closely fitting garments difficult.

In view of the foregoing, it would be desirable to provide a shoe or other article of apparel capable of conforming to various foot or body shapes within a given size range. It would also be desirable to provide a shoe or other article of apparel that is capable of conforming to various double curvatures on the human body and generally providing a good fit. Furthermore, it would be advantageous if such a shoe or other article of apparel could be designed to offer good performance characteristics for multiple uses, such as a cross-training shoe that offers good performance characteristics when the shoe is used for any of a number of different athletic training purposes. In addition, it would be desirable for such a garment or article of apparel to be relatively inexpensive and easy to manufacture.

SUMMARY

An article of footwear includes an upper with at least one laminate panel. The laminate panel includes a bonding layer positioned between a first layer and a second layer. The first layer is a textile having an expansion pattern. The bonding layer provides an auxetic structure that at least partially penetrates the first layer. The laminate panel is configured such that, under load, the bonding layer influences the expansion pattern of the textile layer to control expansion of the first layer.

In accordance with one exemplary embodiment of the disclosure, there is provided an article of apparel comprising an interior layer, an exterior layer, and a bonding layer positioned between the interior layer and the exterior layer. The bonding layer forms an auxetic structure defining a repeating pattern of perimeter walls and interior recesses.

In accordance with another exemplary embodiment of the disclosure, there is provided an article of apparel comprising a first layer and a second layer. An auxetic structure penetrates the first layer. The auxetic structure includes a plurality of interconnected members forming an array of cell units. Each of the plurality of interconnected members form cell walls with interior recesses defined within the cell walls. The second layer is coupled to the first layer via the auxetic structure.

In accordance with yet another exemplary embodiment of the disclosure, there is provided a method of manufacturing a panel for an article of apparel. The method includes printing an auxetic structure on a first side of a first layer, the auxetic structure defining a repeating pattern of perimeter walls and interior recesses. The method further includes allowing the auxetic structure to penetrate into the first layer. Thereafter, the second layer is applied to the first side of the first layer to form the panel. The panel is finish treated with pressure and/or heat such that the second layer is secured to the first layer.

The above described features and advantages, as well as others, will become more readily apparent to those of ordinary skill in the art by reference to the following detailed description and accompanying drawings. While it would be desirable to provide an article of apparel that provides one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

Like reference numerals have been used to identify like elements throughout this disclosure.

DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1:
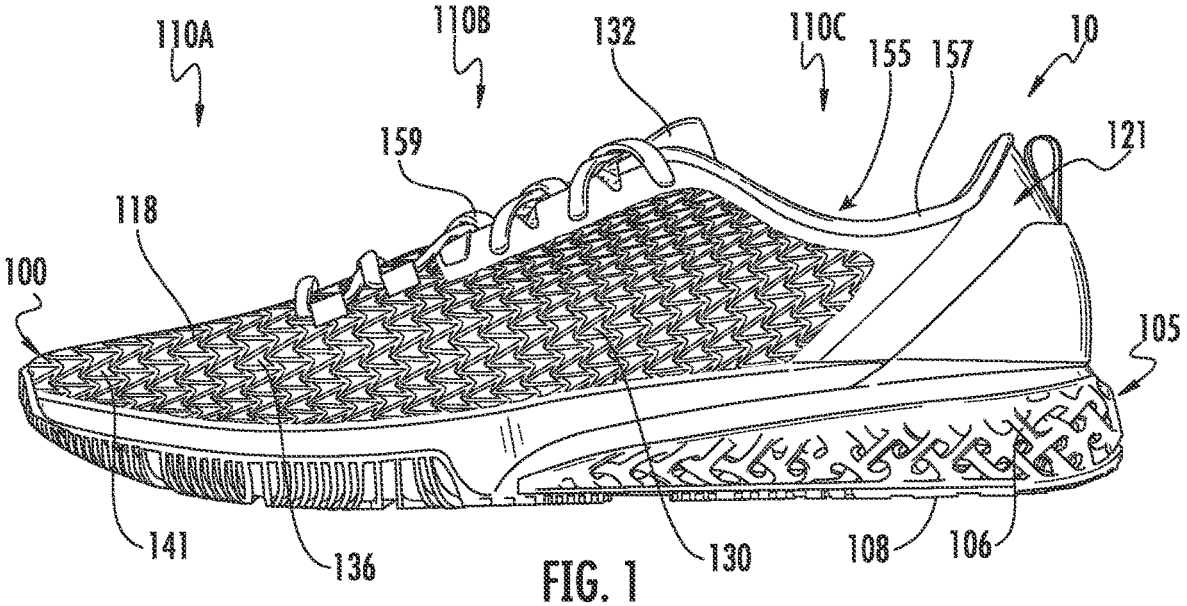
FIG. 1 is a side view of an article of footwear in accordance with an embodiment of the present disclosure.

With reference now to FIG. 1, an article of apparel is shown in the form of an article of footwear 10. The article of footwear 10 is an athletic shoe (e.g., a cross-training shoe) including an upper 100 coupled to a sole assembly 105 (e.g., connected via an adhesive, stitching, etc.). As described in further detail herein, the upper 100 includes a laminate panel 118 formed by a first layer and a second layer with a bonding layer coupling the first layer to the second layer. The bonding layer is printed or otherwise disposed on the first layer as an auxetic layer providing auxetic structure.

The article of footwear 10 defines a forefoot region 110A, a midfoot region 110B, and a hindfoot region 110C, as well as a medial side and a lateral side. The forefoot region 110A is configured to align generally with (be positioned proximate to) the ball and toes of the foot, the midfoot region 110B is configured to align generally with the arch and instep areas of the foot, and the hindfoot region 110C is configured to align generally with the heel and ankle areas of the foot. Additionally, the medial side is oriented along the medial (big toe) side of the foot, while the lateral side is oriented along the lateral (little toe) side of the foot.

The upper 100 includes a plurality of sections that cooperate to define a foot cavity. Specifically, a heel section 121 includes heel cup configured to align with and cover the calcaneus area of a human foot. A medial quarter section 130, disposed forward the heel section 121, is oriented on the medial shoe side. Similarly, a lateral quarter section (not shown), disposed forward the heel section 121, is oriented on the lateral shoe side. A vamp section 136 is disposed forward the quarter sections 130 and a toe cage section 141 is disposed forward the vamp section. The upper 100 may further include tongue 132 disposed within a tongue slot 131 configured to align with and span the instep area of the foot.

The sole assembly 105 typically includes an insole (not shown), a midsole 106, and an outsole 108, which together cushion and protect the user's foot while the user makes contact with the ground. The sole assembly may be a conventional sole assembly, or, as illustrated, may include a mechanical cushioning system as disclosed in U.S. application Ser. No. 15/149,661, the disclosure of which is incorporated herein by reference in its entirety.

With this configuration, the heel 121, lateral quarter and medial quarter 130, vamp 136, toe cage 141, and tongue 132 cooperate with the sole assembly 105 to define a foot cavity into which a human foot is inserted by way of an access opening 155 bounded by a collar 157. The foot may be secured within the cavity utilizing a fastening device 159 such as a lacing system, a cable system, a hook and loop fastener, etc.

Laminate Panel

Figure 2A:
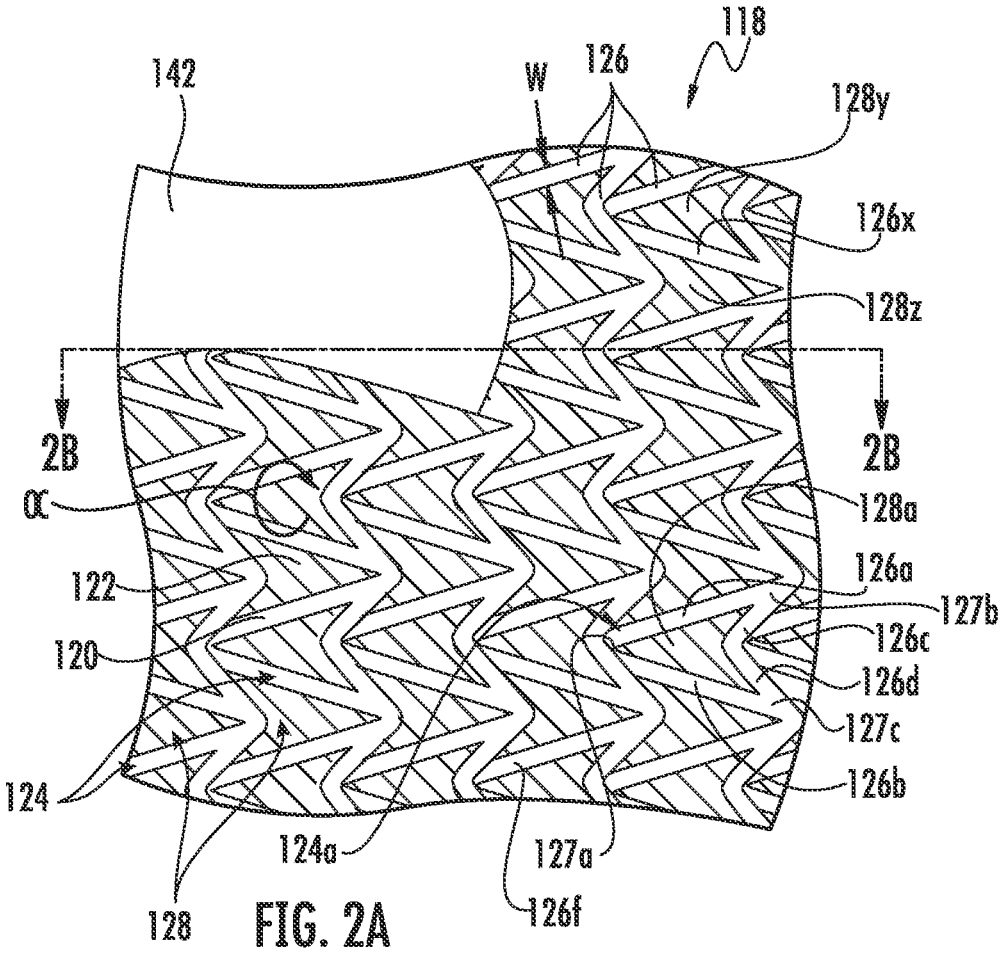
FIG. 2A shows an enlarged plan view of a laminate panel including an outer layer partially cut away to expose an inner layer and an auxetic layer.
Figure 2B:
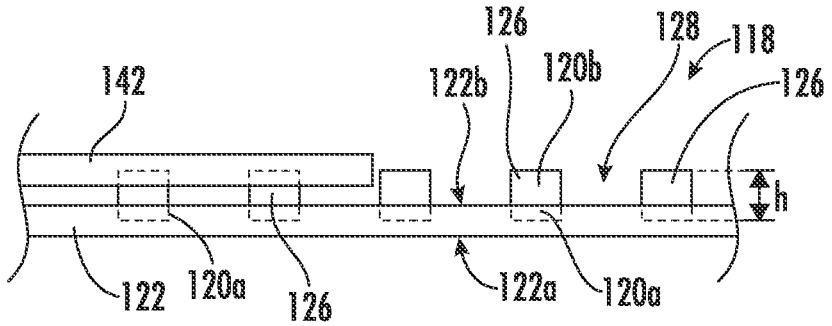
FIG. 2B shows a cross-sectional view of the laminate panel of FIG. 2A along line B-B of FIG. 2A.

All or part of the upper is formed from a laminate panel having a predetermined expansion pattern. As shown in FIGS. 2A-2B, the laminate panel includes an inner layer or lining 122 and an outer layer or face 142 coupled together by a bonding or coupling layer 120. In FIGS. 2A and 2B, the outer layer 142 is partially removed to expose the inner layer 122 and the bonding layer 120.

The inner layer 122 is a sheet of material that may be provided in any of various forms that may be appropriate for an article of apparel, such as a shoe or other article of footwear. In the embodiment of FIGS. 2A and 2B, the inner layer is provided by a textile. Accordingly, the inner layer 122 may also be referred to herein as a "textile layer." The textile layer includes a plurality of strands interconnected via weaving, kitting, braiding, or via a nonwoven process. The strands forming the textile may be any natural or synthetic strands suitable for their described purpose. The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In at least one embodiment, a strand is a yarn, i.e., textile fibers or filaments intertwined in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands, furthermore, may include elastic strands and/or an inelastic strands. An elastic strand is formed of elastomeric material; accordingly, it possesses the ability to stretch and recover by virtue of its composition. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane. In contrast, an inelastic is formed of a non-elastomeric material.

Accordingly, by virtue of its composition, inelastic strands possess no inherent stretch and/or recovery properties. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

It should be noted that an inelastic strand may be modified to possess a topology that enables the strand to provide mechanical stretch and recovery within the textile structure. For example, a hard yarn may be texturized (e.g., crimped) to generate stretch within the yarn.

Preferably, the textile layer is a resilient layer possessing stretch and recovery properties. That is, the textile structure possesses the ability to expand from its original shape/dimensions (stretch), as well as to contract, returning to its original shape/dimensions (recover). Accordingly, the textile layer expands when a tension is placed on the textile (e.g., along the machine direction and/or along the non-machine direction). In an embodiment, the stretch possessed by the lining is at least 5% and/or in a range of from about 5% to about 20%. The stretch of the textile, moreover, may be directional. For example, the textile may possess four-way or two-way stretch capabilities. A textile with "four way" stretch capabilities stretches in a first direction and a second, directly-opposing direction, as well as in a third direction that is perpendicular to the first direction and a fourth direction that is directly opposite the third direction. In other words, a sheet of four-way stretch material stretches in both crosswise and lengthwise. A material with "two way" stretch capabilities, in contrast, stretches to some substantial degree in the first direction and the second, directly opposing direction, but will not stretch in the third and fourth directions, or will only stretch to some limited degree in the third and fourth directions relative to the first and second directions (i.e., the fabric will stretch substantially less in the third and fourth directions than in the first direction and second directions). In other words, a sheet of two-way stretch material stretches either crosswise or lengthwise.

Regardless of the direction of the stretch, during expansion, the textile will possess an expansion pattern. Specifically, textiles generally exhibit a strongly positive Poisson ratio. Thus, when a load or tension is applied to textile (along an axis), the normal stretch pattern causes the textile to constrict along the axis that is perpendicular to the load axis. Stated another way, the expansion pattern of the textile layer is anticlastic, contracting in the directions transverse to the direction of stretching. Upon release of the tension/load, the recovery power of textile returns the fabric to its original shape/dimensions.

With continued reference to FIGS. 2A and 2B, the outer layer 142 is coupled to the inner layer 122 via the bonding layer 120. The outer layer 142 is a sheet of material that may be provided in any of various forms that may be appropriate for an article of apparel, such as a shoe or other article of footwear. For example, the outer layer may be provided by a textile (similar to the inner layer 122), a leather, a synthetic leather (e.g., polyurethane on a fibrous polyester base layer), or any of various polymers or other materials. In embodiments wherein the outer layer 142 is a leather or synthetic leather layer, the outer layer provides relatively limited stretch and expansion properties in comparison to more resilient layers, such as an inner layer comprised of elastic strands. Accordingly, it will be recognized that the outer layer 142 may be provided by a same or similar material to that of the inner layer 122, or may be provided by a completely different material. While the outer layer 142 is shown as having a similar thickness as the inner layer 122 in FIG. 2B, it will be recognized that in at least some embodiments the outer layer 142 is significantly thicker or thinner than the inner layer 122.

During expansion, the material providing the outer layer 142 will possess an expansion pattern. Specifically, leathers and synthetic leathers generally exhibit a significantly positive Poisson ratio. Thus, when a load or tension is applied to the material (along an axis), the normal stretch pattern causes the leather or synthetic leather to constrict along the axis that is perpendicular to the load axis. Upon release of the tension/load, some recovery may occur that allows the material to return closer to its original shape/dimensions. Because the recovery properties of leather and synthetic leathers are limited, and the materials tend to lose their original shape over time.

With continued reference to FIGS. 2A and 2B, the bonding layer 120 is a resilient framework capable of altering the expansion pattern of the face 142 and/or the lining 122. In an embodiment, the bonding layer 120 is formed of a flexible polymer material capable of bonding the inner layer 122 to the outer layer 142 of the panel 118. The bonding layer 120 may be formed by any of various adhesive materials available in any of various forms. Examples of adhesive materials include structural adhesives, pressure sensitive adhesives, and thermosetting structural adhesives, including materials such as epoxies, cements, and elastomer adhesives. The adhesives may be provided in various forms including resins, pastes, liquids, gels, films and supported films. Advantageously, because of the adhesive quality of the bonding layer 120, the inner layer 122 may be connected to the outer layer 142 via the bonding layer alone, without the need for sewing or additional fasteners in order to secure the two layers 122, 142 together. The bonding layer 120 should provide an adhesion strength capable of bonding to and controlling the face and lining. In an embodiment, the bonding layer possesses a dry adhesive strength of about 0.15 kg/cm$^2$ (e.g., at least 0.15 kg/cm$^2$) and a wet adhesive strength of about 0.10 kg/cm$^2$ (e.g., at least 0.12 kg/cm$^2$). By way of example, the bonding layer 120 is a curable polyurethane adhesive applied at a thickness of less than one millimeter (e.g., 0.10-0.20 mm).

The bonding layer 120 is applied to the inner layer 122 and outer layer 142 such that any movement of the bonding layer generates movement in the textile layer, and vice versa. The bonding layer may be directly applied to a textile layer in a liquid or gelatinous state such that the polymer of the bonding layer infiltrates the textile, flowing between the strands. By way of example, the bonding layer 120 may be applied via flow molding. By way of further example, the polymer that forms the bonding layer 120 may be applied via screen printing (e.g., three dimensional screen printing) or an additive manufacturing process (3D printing techniques). In other embodiments, the polymer that forms the bonding layer 120 may be applied in non-solid form and cured. In still other embodiments, the bonding layer 120 is formed separately (e.g., via selective laser sintering/ablation) and is adhered to the base layer via, e.g., an adhesive, welding, etc.

The bonding layer includes a plurality of cells or substructures arranged in an array. The cells are polygons including one or more internal angles that are reflexive (possessing a value between 180°-360°). In other words, the cells are reentrant polygons. The cell array is a structure of interconnected cells, with a cell sharing common borders with adjacent cells. Specifically, the plurality of cells forming the array is organized in a series of columns. In some embodiments (e.g., see FIG. 2A), the cells of adjacent columns are oriented in opposite directions. In other embodiments (e.g., see FIG. 3A), the cells of adjacent columns are oriented along the same direction, but are longitudinally offset such that cells of a first column are staggered relative to the cells of a second, adjacent column. By way of example, the upper end of one cell is oriented proximate the longitudinal center (equator) of its adjacent cell. With either configuration, the cell array is configured such that movement of one cell generates movement in an adjacent cell.

The expansion pattern of the bonding layer differs from the expansion pattern of the textile of the inner layer 122 and the outer layer 142. For example, while the normal stretch pattern of the textile layer is to constrict along the axis that is perpendicular to the load axis, the bonding layer (or portions thereof) may either resist constriction or expand along the axis perpendicular to the load axis. For example, the bonding layer may be synclastic or auxetic, exhibiting a negative Poisson's ratio.

The bonding layer 120 is sandwiched between the inner layer 122 and the outer layer 142 and couples the inner layer 122 to the outer layer 142. The bonding layer 120 may be coupled to (e.g., mounted on or embedded in) the inner layer 122 or the outer layer 142, and the other layer may be applied to the bonding layer 120 to form the textile laminate, with the inner layer 122, the outer layer 142, and the bonding layer being generally coextensive across the laminate. The bonding layer 120 is configured to influence the textile layer during expansion, altering the expansion pattern of the inner and/or outer layers of the laminate panel. That is, during expansion of the laminate panel, the expansion pattern of the bonding layer 120 has an effect on the expansion pattern of the inner layer 122 and/or outer layer 142. Accordingly, the bonding layer drives the expansion of the laminate panel in a predetermined pattern that differs from the native expansion pattern of the inner and outer layers and is closer to that of the bonding layer.

Accordingly, when coupled to the inner layer 122 and outer layer 142, the bonding layer 120 (the cell array) may work to resist deformation and shrinkage in the inner layer 122 and the outer layer 142. Specifically, the bonding layer is configured to lower the Poisson ratio of the fabric or leather, making the ratio of the laminate panel 118 (i.e., the combined structure textile layer/polymer layer structure) less positive. In some embodiments, the Poisson ratio of the resulting laminate panel is less strongly positive. In other embodiments, it is zero; in others, it the Poisson ratio is negative. For example, the laminate panel 118 (or portions thereof) may possess a negative Poisson's ratio, generating a synclastic or auxetic expansion pattern in which the function laminate expands along the axis perpendicular to the load axis (expands in directions transverse to the direction of stretching). The inner and outer layers 122, 142, however, may possess greater recovery power than the bonding layer 120. Accordingly, upon removal of the load along the load axis, the inner and outer layers 122, 142 may draw the bonding layer 120 back to its contracted configuration. In this manner, each layer plays a role in the combined structure, driving expansion or contraction behavior of the laminate panel.

EXAMPLES

Referring again to the embodiment of FIGS. 2A and 2B, an enlarged view of the laminate panel 118 is shown with the outer layer 142 partially removed to show the inner layer 122 (which may also be referred to herein as the "base layer") and the bonding layer 120 (which may also be referred to herein as the "auxetic layer" or an "auxetic bonding layer"). The auxetic layer 120 includes a first portion 120*a* that penetrates the base layer 122 (as noted by the dotted lines in the base layer 122 in FIG. 2B), and a second portion 120*b* that is above or outwardly from the base layer 122. The first portion 120*a* of the auxetic layer 120 penetrates through at least a first surface 122*a* of the base layer 122, and in some embodiments, the first portion 120*a* may penetrate completely through the base layer 122 to a second surface 122*b* of the base layer 122. As a result, the auxetic layer 120 is at least partially embedded in the base layer 122 and may not be removed or peeled away from the base layer 122 without destruction of either the auxetic layer 120 or the base layer 122.

When the panel 118 is implemented in an article of footwear, the first surface 122*a* of the base layer 122 is an inner surface that faces inwardly toward the foot cavity, and the second surface 122*b* is a middle surface that faces the outer layer 142. For clarity in FIG. 2A, the base layer 122 is shown as the cross-hatched portion under the auxetic layer 120 which does not include any cross-hatching. Therefore, it will be recognized that the cross-hatching in FIG. 2A is for purposes of contrast only, and does not indicate any cross-section or particular material.

As indicated above, the auxetic layer 120 includes an auxetic structure provided by a plurality of interconnected segments 126 arranged in a manner to provide a repeating pattern of reentrant shapes (i.e., concave polygons). In the embodiment of FIG. 2A, the repeating pattern of reentrant shapes is an array of reentrant shapes which may be considered to exist in rows and columns of the auxetic structure.

The interconnected segments 126 form the reentrant shapes in the auxetic structure, and an interior recess 128 is defined within each reentrant shape. In the embodiment of FIGS. 2A-2B, the auxetic layer 120 separates the base layer 122 from the outer layer 142 (as shown on the left side of FIG. 2B). Thus, in this embodiment, portions of the interior recess 128 are void of material between the base layer 122 and the outer layer 142. However because the first portion 120*a* of the bonding layer penetrates the base layer 122, portions of the base layer 122 fill the interior recesses at the first portion 120*a* of the bonding layer 120. Similarly, because the second portion 120*b* of the bonding layer penetrates the outer layer 142, portions of the outer layer 142 fill the interior recesses at the second portion 120*b* of the bonding layer 120.

The reentrant shapes formed by the interconnected segments 126 may be any of various shapes capable of providing an auxetic structure. In the embodiment of FIGS. 2A-2B, the reentrant shapes formed by the interconnected segments are arrowhead shapes (which may also be referred to herein as "chevron" shapes). Segments 125A-125D in FIG. 2A illustrate a group of interconnected segments that form an arrowhead shape. Segments 125A and 125B are connected at a leading vertex 127*a* and form a first acute interior angle for the reentrant shape. Segments 125A and 125C are connected at a first trailing vertex 127*b* and form a second acute interior angle. Segments 125B and 125D are connected at a second trailing vertex 127*c* and form a third acute interior angle. Segments 125C and 125D are connected at a concave portion of the reentrant shape and form a reflexive interior angle.

Together, each set of interconnected segments 126 forming a reentrant shape and the associated interior recess 128 forms a cell unit 124. For example, in FIG. 2A, segments 125A-d and interior recess 128*a* forms cell unit 124*a*. While each cell unit has a unique interior recess 128, cell units may share the same segment 126. In other words, each segment 126 may border more than one interior recess 128. For example, in FIG. 2A, segment 126*x* borders interior recess 128*y* and 128*z*. Accordingly, it will be recognized that each segment 126 may be considered to be a part of multiple cells and, therefore, each segment 126 may be considered to a portion of two different reentrant shapes. Because the segments 126 surround an interior recess 128 in the auxetic structure, the segments 126 may also be referred to herein as "perimeter walls," "cell walls," or "interconnected members." In the embodiment of FIG. 2A, the auxetic structure includes an array of cell units which may be considered to exist in rows and columns of the auxetic structure. However, because each interconnected segment 126 may be shared by two different cell units 124, the areas covered by the individual rows and columns overlap within the auxetic structure.

In at least one embodiment, the auxetic layer 120 is a continuous structure, with each cell unit 124 sharing segments 126 with at least one adjacent cell unit or partial cell unit. Accordingly, the material forming the segments 126 is continuous and uninterrupted across the auxetic structure. However, as noted above, the first portion 120*a* of the auxetic layer 120 is embedded in the base layer 122 and therefore fibers of the base layer are present within the auxetic layer. The auxetic structure may be formed using any of various processes such as screen printing and/or three-dimensional printing, examples of which are discussed in further detail below.

In the embodiment of FIG. 2A-2B, the segments 126 are generally uniform in width (i.e., the distance across the segment parallel to the base layer 122), but are staggered in height. For example, as shown in FIG. 2A, each segment 126 has a width, w, which is generally uniform. In at least one embodiment, this width w is between 1 mm and 5 mm, and particularly about 2 mm.

As shown in FIG. 2B, each segment 126 has a height, h, defined between the top surface and the bottom surface of the segment 126. In at least one embodiment, the height h is between 0.5 mm and 4 mm, and particularly about 2 mm.

The interconnected segments 126 of the auxetic layer 120 may be provided by any of various materials suitable for the desired purposes of the auxetic layer. In at least one embodiment, the wall material forming the interconnected segments 126 comprises a resilient polymer material such as ethylene-vinyl acetate (EVA), a thermoplastic such as nylon, or a thermoplastic elastomer such as polyurethane. Each of these materials may mixed with other materials to provide adhesive properties for the auxetic layer 120. The auxetic layer 120 may be provide in a liquid or gelatinous state when applied to the base layer 122 and then fully or partially cured before the outer layer 142 is applied, as discussed in further detail below.

As noted previously, the bottom surface of the auxetic layer 120 is embedded in the base layer 122, while the top surface of the auxetic layer is exposed to the outer layer 142. The auxetic layer 120 may be embedded in the base layer 122 using any of various methods, including seeping of printed liquid and subsequent curing, heat fusing, or any of various other methods as will be recognized by those of ordinary skill in the art. In at least one embodiment, the auxetic layer 120 is printed directly on to the base layer 122 in a liquid or gelatinous form using a screen printing process. After the auxetic layer is printed, the liquid or gelatinous material slowly seeps into the base layer 122 and subsequently cures. In at least one alternative embodiment, the auxetic layer 120 is brought into contact with the base layer 122 while the auxetic layer 120 is in a solid state, and then heat is applied to bring the auxetic layer 120 to a liquid or semi-liquid (partially melted) state. With the auxetic layer in a liquid or semi-liquid state, the material of the auxetic layer 120 that is in contact with the base layer 122 infiltrates the base layer fabric. Alternatively, the auxetic layer 120 may be applied to the base layer 122 in a molten or semi-molten state (e.g., during an inkjet printing process). In each of these embodiments, once cooled or otherwise cured, the auxetic layer 120 is securely fixed (permanently connected) to the fibers of the base layer 122 such that any movement of the base layer is transferred to the auxetic layer, and vice versa.

The outer layer 142 of the laminate panel 118 is connected to the base layer 122 via the auxetic layer 120. In at least one embodiment, the outer layer 142 is provided by a stretch fabric (e.g., a four-way stretch material) such that the inner layer 122 and the outer layer 142 are similarly influenced by the auxetic layer 120. In another embodiment, the outer layer 142 is a relatively inelastic material (e.g., a leather material) that limits the overall auxetic properties of the laminate panel 118. The outer layer 142 may be connected to the auxetic layer 120 via any of various means, including adhesives inherent in the auxetic layer 120, molding, welding, sintering, stitching or any of various other means. In at least one embodiment, the outer layer 142 is brought into contact with the auxetic layer 120 and then heat is applied to place the material forming the auxetic layer in a semi-liquid (partially melted) state. The material forming the auxetic layer then infiltrates the outer layer fabric such that the auxetic layer 120 is at least partially embedded in the outer layer 142. Alternatively, the outer layer 142 may be applied to the auxetic layer 120 with the auxetic layer in a molten or semi-molten state. In either application, once cooled or otherwise cured, the auxetic layer 120 is securely fixed (permanently connected) to the fibers of the outer layer 142 such that any movement of the outer 142 layer is transferred to the auxetic layer 120, and vice versa.

The structure of the laminate panel 118, including the auxetic layer 120, the base layer 122, and the outer layer 142, provides improved contouring properties around a three-dimensional object compared to a structure including only the base layer and/or the outer layer. For example, when incorporated into an article of footwear 10, the vamp easily and smoothly conforms to the various shapes and curvatures present on the foot. The laminate panel 118 is capable of double curvature forming synclastic and/or anticlastic forms when stretched. Double curvatures are prevalent along the length of the human foot. Accordingly, the laminate panel 118 providing the vamp 136 will follow the curvatures of the foot with little to no wrinkling or folding visible to the wearer. Furthermore, the inherent features and characteristics of the laminate panel 118 allow the vamp 136 to be provided as a single panel that extends across a wide region of the article of footwear 10.

Figure 3A:
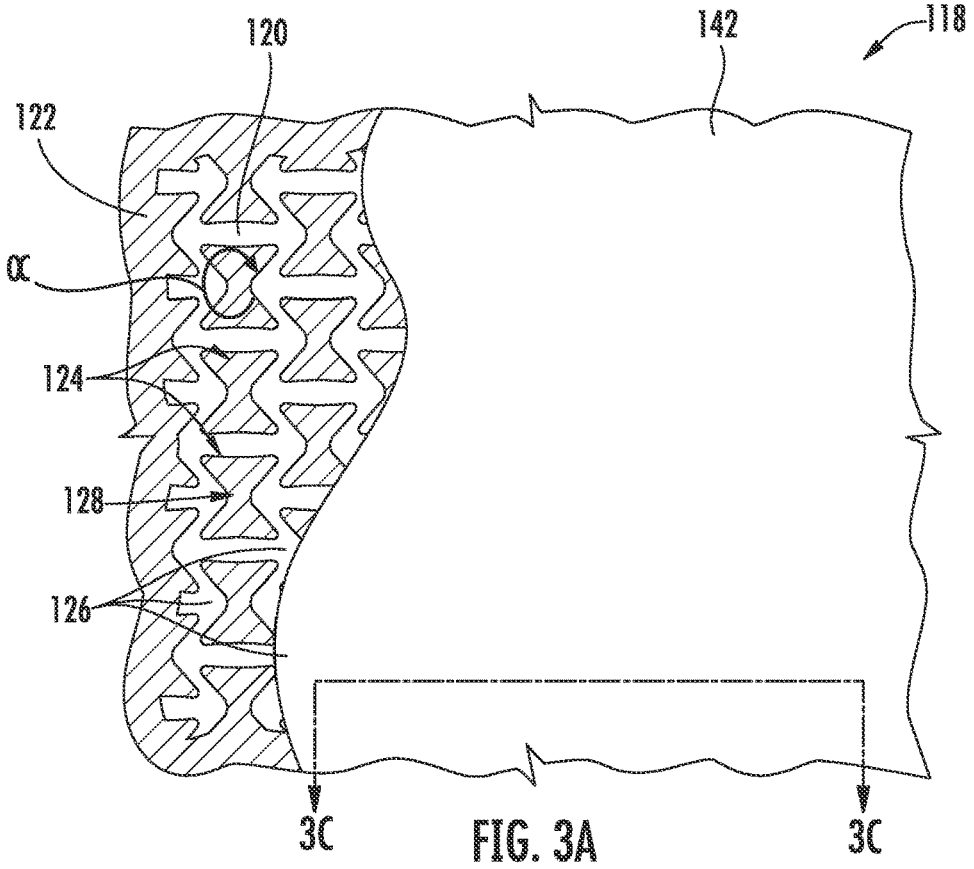
FIG. 3A shows an alternative embodiment of the laminate panel of FIG. 2A with an out layer partially cut away to expose an inner layer and an auxetic layer.
Figure 3B:
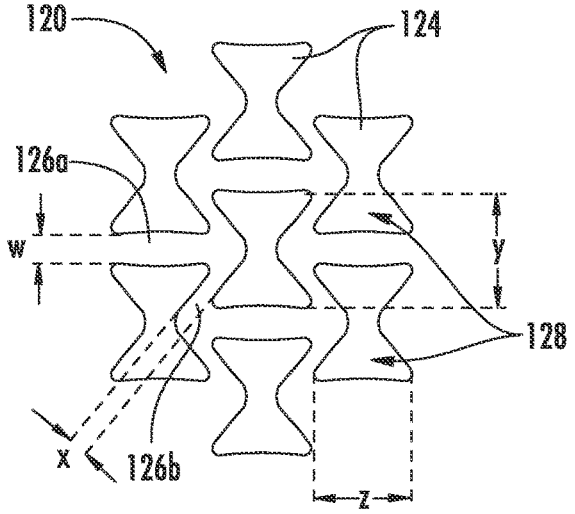
FIG. 3B shows an enlarged, schematic view of the auxetic layer of the laminate panel of FIG. 3A, showing exemplary dimensions of the interconnected segments of the auxetic layer.
Figure 3C:
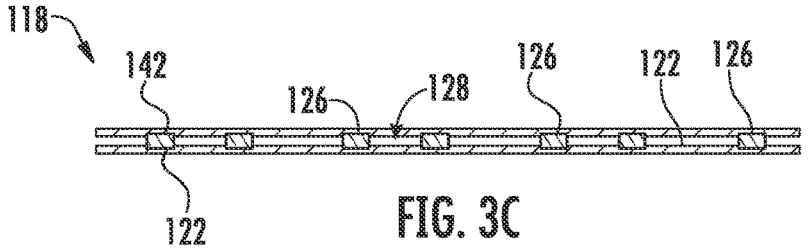
FIG. 3C shows a cross-sectional view of the laminate panel of FIG. 3A.

While FIGS. 2A and 2B show one embodiment of an laminate panel 118 that may be used on the article of footwear 10, it will be recognized that the laminate panel 118 may take a number of different forms. For example, in lieu of the auxetic layer 120 of FIGS. 2A-2B wherein the reentrant shapes are provided in the form of arrowhead shapes, the auxetic structure of FIGS. 3A-3C may be used, wherein the reentrant shapes are hourglass or bow-tie shapes (which may also be referred to as "auxetic hexagons"). Although the shapes formed by the interconnected segments 126 are different in FIG. 3A from the shapes formed in FIG. 2A, it will be recognized that both embodiments share a number of similarities. For example, the laminate panel 118 in FIGS. 3A-3C also includes an auxetic layer 120, a base layer 122, and an outer layer 142. The auxetic layer 120 includes a plurality of interconnected segments 126 that form cells units 124 oriented in an array, each cell unit being positioned in horizontal rows and vertical columns. The interconnected segments 126 may have different widths, as noted in FIG. 3B by widths "w" and "x". An interior recess 128 is formed within each cell unit 124, with the interior recess 128 bordered by the surrounding interconnected segments 126. The width "y" across on of the interior recesses 128 is generally greater than the width "w" or "x" across one of the interconnected segments 126. As shown in FIG. 3C, the interconnected segments 126 penetrate the base layer 122 and the outer layer 142. While the recesses 128 are shown in FIG. 3C as including voids positioned between the base layer 122 and the outer layer 142, in at least one embodiment the outer layer 142 is in contact with the base layer 122, and the recesses 128 are substantially filled with material from either the base layer 122 or the outer layer 142.

Figure 4A:
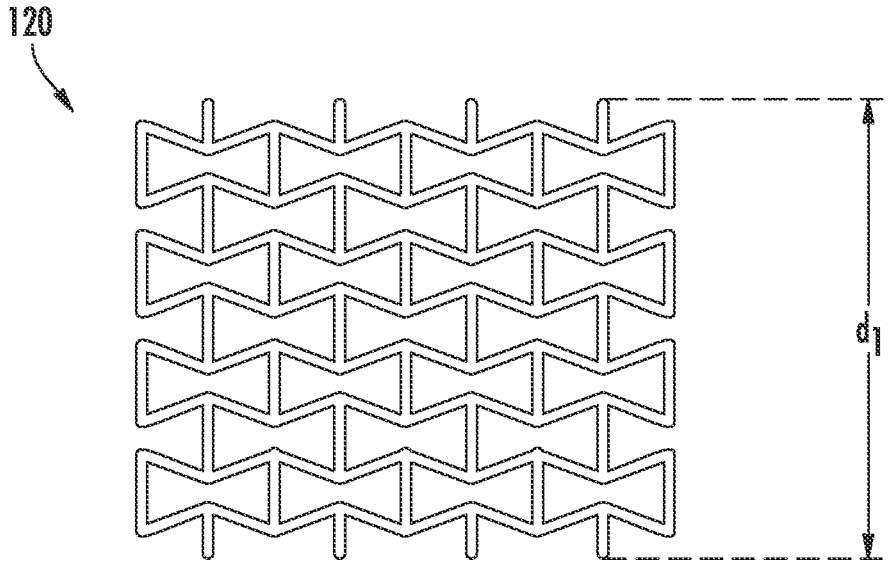
FIG. 4A shows a plan view of an auxetic layer of the laminate panel of FIG. 3A in a contracted position.
Figure 4B:
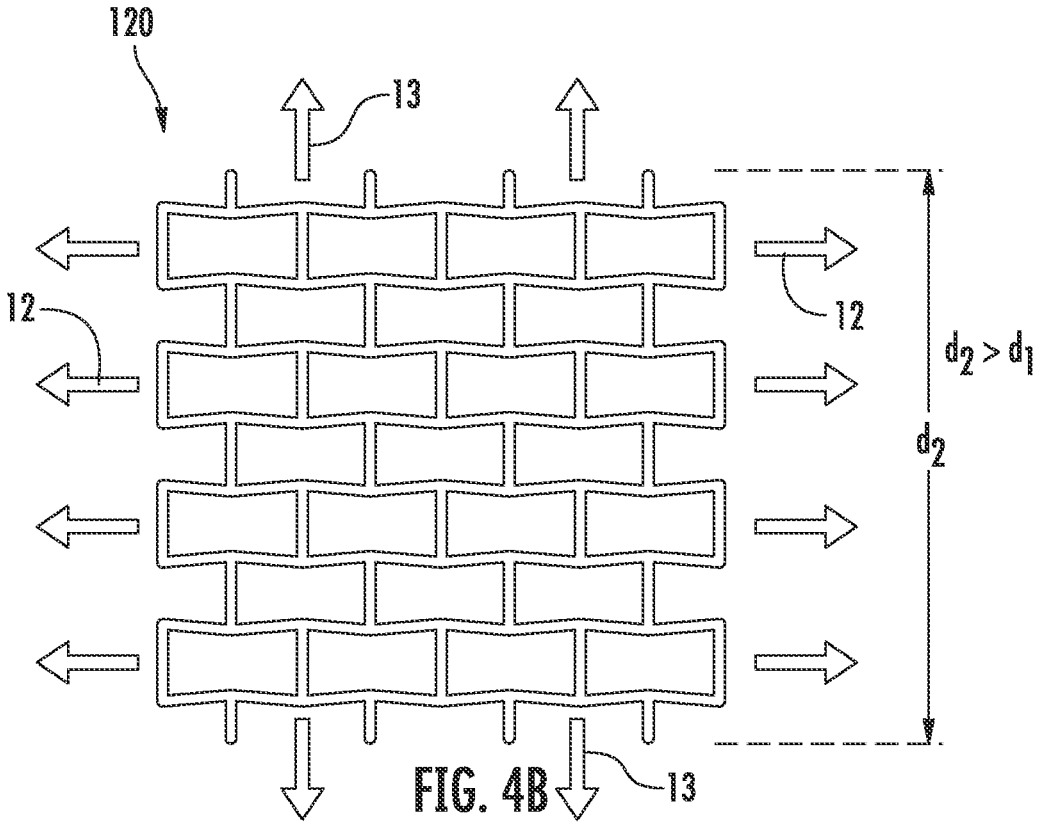
FIG. 4B shows a plan view of the auxetic layer of FIG. 4A in an expanded position.

FIGS. 4A and 4B illustrate the operation of one auxetic structure that may be used as the auxetic layer. In particular FIG. 4A shows the auxetic layer 120 of FIG. 3A separated from the base layer 122 and the outer layer 142 in its normal, unstretched state. The thickness (or width) of the auxetic layer 120 in the unstretched state is indicated as d1. FIG. 4B shows the auxetic layer 120 stretched in the direction of arrows 12. The thickness of the auxetic layer in the stretched state is indicated by d2. As can be seen in FIG. 4B, when tension is applied along a first direction (indicated by arrows 12), the auxetic structure is stretched, expanding (i.e., becoming thicker) in a second direction (indicated by arrows 13) that is perpendicular to the first direction such that in the stretched state d2>d1. This is the result of the pivoting/rotation that occurs along the vertices of the reentrant shape (i.e., where the ends of the interconnected segments form corners of the polygons in the reentrant shape). It will be appreciated that the auxetic layer 120 of FIG. 2A is also configured to expand in a similar manner to the auxetic layer of FIG. 4A.

The term "auxetic structure" as used herein generally refers to a structure provided in a configuration that, depending on an appropriately flexible material being used, will have a near zero or negative Poisson's ratio. In other words, when stretched, auxetic structures tend to become thicker (as opposed to thinner) or expand in a direction perpendicular to the applied force, or at least do not contract to a significant extent in a direction perpendicular to the applied force. This generally occurs due to inherent hinge-like components between the interconnected segments which flex when stretched. In contrast, materials with a positive Poisson's ratio that is not near zero contract to a significant extent in a direction perpendicular to the applied outward force (i.e., perpendicular to the direction of stretch). As used herein, an auxetic structure having a "near zero" Poisson's ratio is a structure exhibiting a Poisson's ratio of approximately zero and, in particular, less than +0.15.

The term "auxetic" as used herein is not limited to structures that actually have a near zero or negative Poisson's ratio in operation or implementation. The reason for this is that an entire auxetic structure, or portions thereof, may be practically locked in place and substantially prohibited from expansion or contraction in either direction. For example, a structure comprised of glass may still be considered an "auxetic structure" if it is provided with the appropriate array of reentrant shapes, although forces attempting to stretch the structure will typically result in the structure breaking rather than expanding. Also, components or materials adjacent to, within, or surrounding the auxetic structure may prevent the auxetic structure from exhibiting a near zero or negative Poisson's ratio when stretched. An example of an auxetic structure that may not exhibit a zero or negative Poisson's ratio when stretched may be realized in association with the laminate panel 118 of FIGS. 2A and 2B when either the inner layer 122 or the outer layer 142 is a relatively inelastic material, such as leather.

In addition to the foregoing, it will be recognized that whether a structure has a negative Poisson's ratio, may depend upon the degree to which the structure is stretched. Structures may exhibit a negative Poisson's ratio up to a certain stretch threshold, but when stretched past the threshold may have a positive Poisson's ratio. For example, it is possible that when the auxetic layer 120 in FIG. 4A is stretched in the direction of arrows 12 past a threshold expansion position (e.g., past the state shown in FIG. 4B), the cells and segments of the auxetic structure may be stretched to an extent that the auxetic structure becomes slightly thinner (in the direction perpendicular to arrows 12) before the structure is torn apart or otherwise damaged.

In the embodiments disclosed herein, auxetic structures are formed from a plurality of interconnected segments 126 forming an array of cell units 124, and each cell unit has a "reentrant shape". As used herein, the term "reentrant shape" may also be used to refer to a "concave", or "non-convex" polygon or shape, which provides shape having an interior angle with a measure that is greater than 180°. The angle $\alpha$ shown in each of FIGS. 2A and 3A is an angle in a reentrant shape having a measurement of greater than 180°. The auxetic layers 120 in FIGS. 2A and 3A are two examples of such an auxetic structure defining a reentrant shape. It will be appreciated that numerous other auxetic structures are possible. Examples of other auxetic structures are shown in FIGS. 5A-5D.

Figure 5A:
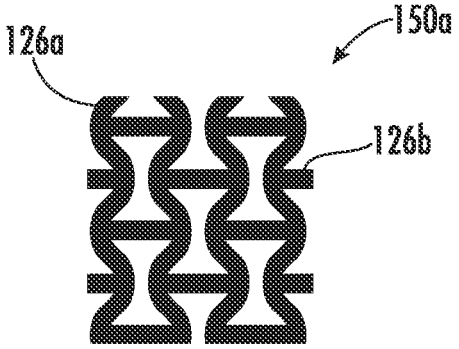
FIG. 5A shows a plan view of an alternative embodiment of the auxetic layer of FIG. 4A.

FIG. 5A shows an auxetic structure 150*a* in the form of a wave hourglass configuration. In this embodiment of the auxetic structure, the segments 125A positioned along one axis (i.e., the vertical axis in FIG. 5A) are curved or sinusoidal, and the segments 125B along another axis (i.e., the horizontal axis in FIG. 5A) are straight or relatively linear. The auxetic structure 150*a* of FIG. 5A has the advantage of being form fitting and strongly tunable.

Figure 5B:
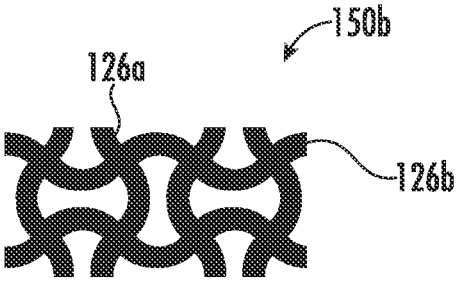
FIG. 5B shows another alternative embodiment of the auxetic layer of FIG. 4A.

FIG. 5B shows another auxetic structure 150*b* in the form of a double wave configuration. In this embodiment of the auxetic structure, the segments 125A positioned along one axis (i.e., the vertical axis in FIG. 5B) are curved or sinusoidal in shape, and the segments 125B along another axis (i.e., the horizontal axis in FIG. 5B) are also curved or sinusoidal in shape. Similar to the auxetic structure 150*a* of FIG. 5A, the auxetic structure 150*b* of FIG. 5B has the advantage of being form fitting, strong, and easily tunable.

Figure 5C:
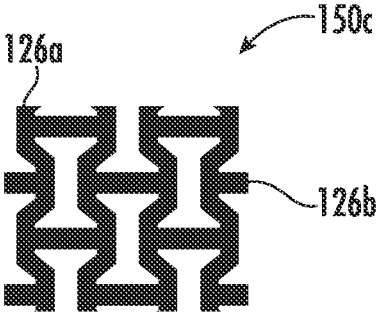
FIG. 5C shows yet another alternative embodiment of the auxetic layer of FIG. 4A.

FIG. 5C shows another auxetic structure 150*c* in the form of a hinged hourglass configuration. In this embodiment of the auxetic structure, the segments 125A positioned along one axis (i.e., the vertical axis in FIG. 5C) are a combination of square and triangular in shape, and the segments 125B along another axis (i.e., the horizontal axis in FIG. 5C) are also straight or relatively linear. Similar to the auxetic structure 150*a* and 150*b* of FIGS. 5A and 5B, the auxetic structure 150*c* of FIG. 5C has the advantage of being form fitting, strong, and very tunable.

Figure 5D:
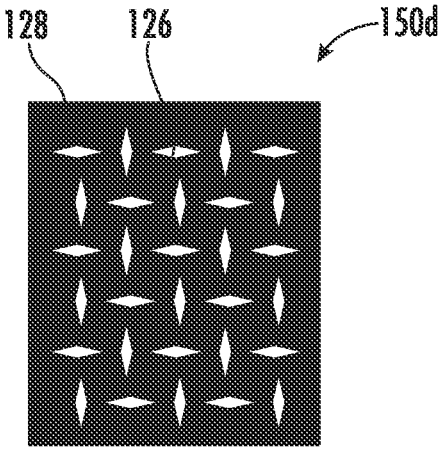
FIG. 5D shows another alternative embodiment of the auxetic layer of FIG. 4A.

FIG. 5D shows another auxetic structure 150*d* in the form of a tessellating planes configuration. In this embodiment of the auxetic structure, the segments 126 are generally square or rectangular in shape, and recesses 128 are generally diamond shaped, with an edge of each square or rectangular segment defined along one of the edges of the diamond shaped recesses. While the auxetic structure 150*d* of FIG. 5D is less form fitting and tunable than the auxetic structures 150*a*, 150*b*, and 150*c* of FIGS. 5A-5C, the auxetic structure has the advantage of being very strong.

As noted previously, the laminate panel 118, including an inner layer 122, bonding layer 120 providing an auxetic structure, and outer layer 142, is incorporated into an article of apparel. For example, the laminate panel 118 may be provided on an article of footwear. FIG. 1 shows the article of footwear 10 as a shoe that includes an upper 100 made from the laminate panel 118. The article of footwear 10 includes an upper 100 and a sole assembly 105 including a midsole 106 and an outsole 108.

Figure 6:
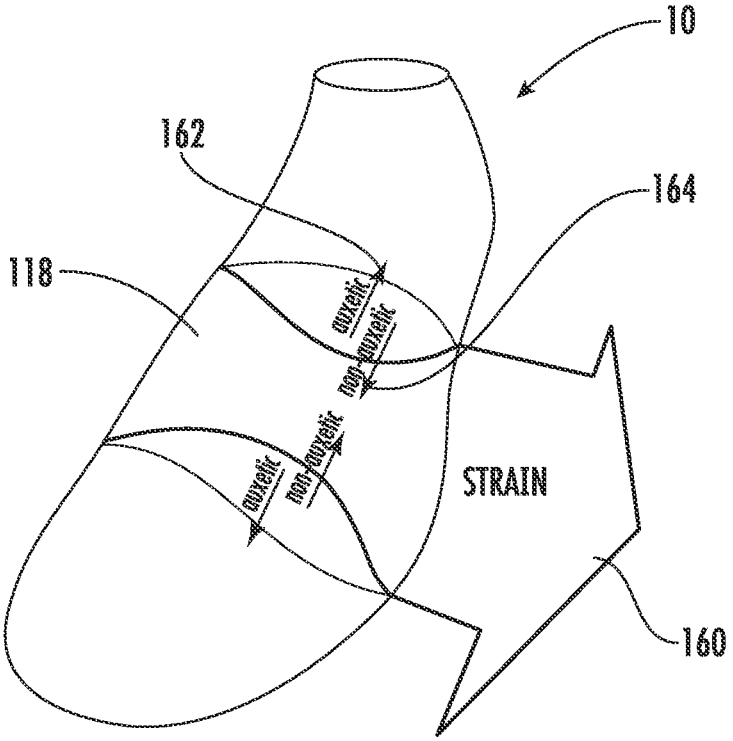
FIG. 6 shows a perspective view of how the laminate panels of FIGS. 2A and 3A are configured to expand when a strain is applied to the laminate panel.

FIG. 6 illustrates one benefit to providing the laminate panel 118 on the upper of an article of footwear 10. In particular, when a user cuts, pivots, or otherwise moves with the article of footwear 10 on his or her feet, the user's foot will apply a straining force on the laminate panel 118 of the upper. When the upper 100 with the laminate panel 118 is subjected to strain in one direction (e.g., the direction indicated by the arrow 160 in the illustration of FIG. 6), the auxetic structure of the bonding layer 120 influences the panel 118 to expand in the direction perpendicular to the applied force (i.e., the direction indicated by arrows 162). This expansion in the perpendicular direction is different from prior art panels that contract in the direction perpendicular to the applied force (i.e., in the direction indicated by arrows 164). Accordingly, the laminate panel 118 provides the benefit of spreading a load that is concentrated on a relatively small surface area across a significantly greater surface area of the upper. Additionally, the laminate panel 118 provides improved contouring properties around a three-dimensional object compared to a structure including only the base layer and/or the outer layer. For example, when incorporated into an article of footwear 10, the vamp easily and smoothly conforms to the various shapes and curvatures present on the foot.

Method of Making an Article of Apparel

Figure 7:
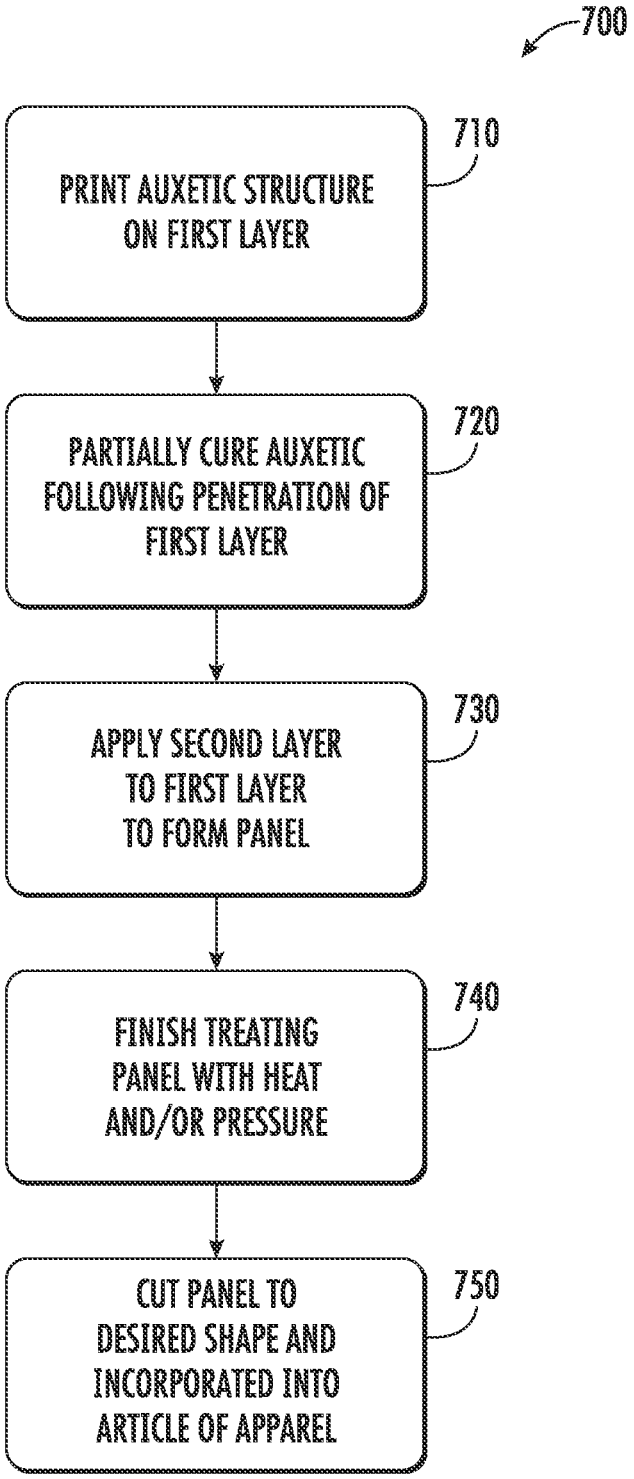
FIG. 7 shows a method of making a panel for an article of apparel including the laminate panels of FIGS. 2A and 3A.

With reference now to FIG. 7, a method 700 of making an article of apparel is shown. The method 700 begins in step 710 with the auxetic bonding layer 120 being applied to the base layer 122. The auxetic bonding layer 120 may be applied to the bonding layer 122 with the material providing the bonding layer in a liquid, semi-liquid, paste, or gelatinous form. Any of various means may be used to apply the auxetic bonding layer 120 to the base layer, such as screen printing, inkjet printing, 3D printing, or any of various other means.

After the auxetic bonding layer 120 is applied to the base layer 122, the material of the auxetic bonding layer 120 penetrates the base layer 122 by seeping through a first surface of the base layer 122 and into the body of the base layer. This results in the auxetic bonding layer 120 being embedded in the base layer 122. Thereafter, the auxetic bonding layer 120 is apt least partially cured as shown in step 720. Curing of the auxetic bonding layer 120 may occur using any of various means appropriate for the material used for the auxetic bonding layer. For example, depending on the material used for the auxetic bonding layer, heat, pressure, cooling, UV light, time-setting, or any of various other appropriate means may be used to completely or partially cure the auxetic bonding layer 120. Once cured or partially cured, the auxetic bonding layer 120 is hardened to some extent and connected to the base layer 122, the auxetic bonding layer 120 being embedded in the base layer 122 in a manner such that the auxetic bonding layer 120 cannot be removed from the base layer 122 without destruction of either the auxetic bonding layer 120 or the base layer 122.

After the auxetic bonding layer 120 is at least partially cured in step 720, the method continues to step 730 and the outer layer 142 is attached to the base layer 122 by applying the outer layer 142 to the exposed side of the auxetic bonding layer 120. As a result, the auxetic bonding layer 120 is sandwiched between the base layer 122 and the outer layer 142, and this three-layered arrangement forms the laminate panel 118. If the auxetic bonding layer 120 was only partially cured in step 720, the auxetic bonding layer 120 may remain somewhat soft, as a paste, semi-liquid, or gelatinous material. This material may then seep into the fibers of the outer layer 142 before the auxetic bonding layer 120 is fully cured. Alternatively, if the auxetic bonding layer 120 was fully cured in step 720, the outer layer 142 may rest on top of the exposed surface of the auxetic bonding layer 120.

Thereafter, in step 740 of FIG. 7, the laminate panel 118 is finish treated to further secure the three layers of the laminate panel 118 together. In at least one embodiment, the laminate panel 118 is finish treated by applying heat and/or pressure to the laminate panel 118. For example, the laminate panel 118 may be placed in a heat press and a heated plate may be forcibly applied to the outer surface of the outer layer 142 (i.e., the surface opposite the auxetic bonding layer 120). The heat and pressure applied in this finishing process causes the auxetic bonding layer 120 to more completely mix with the fibers of the outer layer 142 and the base layer 122. In at least one embodiment, the finish treatment may be designed to further cure the auxetic bonding layer 120 using any of various means such as application of heat, cooling, application of UV light, time, or any of various other curing processes.

Alternatively, or in addition to one or more of the foregoing processes, the finish treating the laminate panel 118 in step 740 may include additional processes. One example of such an additional process is embossing the laminate panel 118 in order to emphasize the auxetic structure provided by the bonding layer 120. Any of various embossing processes may be used, such as cold molding, heat embossing, registration, etc. As another example, the laminate panel may be pressed or stretched to enhance the visual effects of the auxetic bonding layer 120 of the laminate panel 118. The visual effect of the auxetic layer tends to be more prominent on a thinner textile layer. Therefore, if the outer layer 142 is a leather or synthetic leather, and the inner layer 122 is a four-way stretch material (or other relatively thin textile), the visual effect of the auxetic bonding layer 120 will not be prominent on the exterior of the article of footwear or other article of apparel. However, if the outer layer 142 is a four-way stretch material, the visual effect of the auxetic bonding layer may be very prominent, similar to that shown in FIG. 1. In at least one embodiment, the visual effect of the auxetic bonding layer is made more prominent by the auxetic bonding layer 120 having a relatively dark or bright color (e.g., black, blue, red, etc.), and the outer layer 142 being a light colored sheer material (e.g., a white 4-way stretch material). In these embodiments, the auxetic bonding layer 120 is visible through the sheer outer layer 142 and provides and interesting visual effect for the article of apparel, similar to that shown in FIG. 1.

Referring again to the method of FIG. 7, after the laminate panel 118 is finish treated, the method 700 continues to step 750, and the laminate panel 118 is cut to a desired shape and incorporated into the article of apparel. Advantageously, the auxetic properties of the laminate panel 118 are such that a single piece of the laminate panel 118 may be used to extend across a wide region of the article of apparel. For example, when incorporated into an article of footwear 10 such as that of FIG. 1, the vamp easily and smoothly conforms to the various shapes and curvatures present on the foot.

While the invention has been described in detail and with reference to specific embodiments thereof, it will be apparent to one skilled in the art that various changes and modifications can be made therein without departing from the spirit and scope thereof. For example, while the embodiments disclosed herein show an article of apparel in the form of an article of footwear, and particularly a shoe, it will be recognized that the term "article of apparel" as used herein refers to any garment, article of footwear or accessory configured to be worn on or carried by a person (whether human or otherwise). Examples of articles of apparel include helmets, hats, caps, shirts, pants, shorts, sleeves, knee pads, elbow pads, shoes, boots, backpacks, duffel bags, cinch sacks, and straps, as well as numerous other products configured to be worn or carried by a person. Examples of other articles of footwear include socks, boots, cleats, or any of numerous other products configured to be worn in association with the foot of a person.

While the figures disclosed herein reference various regions of the article of footwear 10, including the forefoot region 110A, midfoot region 110B, and heel region 110C, it will be recognized that each of these regions generally corresponds to a region of a human foot associated with such region in the article of footwear 10. Furthermore, it will be recognized that overlap may occur between regions or that a transition region may be defined between each of these regions. Accordingly, when various portions of the upper 100 or sole assembly 105 are described herein as extending to different "regions", it will be recognized that these regions may be generally defined with reference to a human foot positioned within the associated article of footwear.

The components of the upper 100 may be presented in any of various configurations and thereby provide different forms of the footwear. For example, the upper 100 of FIG. 1 may be configured as a low-cut running shoe, a high-top basketball shoe, or any of various other forms of athletic shoes. The upper 100 may also be configured with various tightening mechanisms to secure the article of footwear 10 to the foot of the wearer. For example, the upper 100 may be configured such that the article of footwear is a lace-up shoe, a slip-on shoe, or a strap-tightened boot.

With the above-described construction, a laminate is provided that possesses a lower Poisson ratio than the laminate would have without the bonding layer. In particular, it is possible to form a laminate that, while not including any individual textile (facing or lining) layer possessing auxetic (or near auxetic) properties, functions as an auxetic or near auxetic once coupled to the bonding layer.

The described process further reduces the cost of forming auxetic structures. Forming auxetic textiles is expensive, involving the manipulation of strands and their location in specific locations within a textile structure. Accordingly, the described process enables formation of auxetic textiles at a lower price point via a simplified process.

The foregoing detailed description of one or more exemplary embodiments of the articles of apparel including auxetic materials has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. An article of apparel comprising:

a first layer;

a second layer; and a bonding layer positioned between the first layer and the second layer, the bonding layer forming an auxetic structure defining a repeating pattern of perimeter walls and interior recesses.

2. The article of apparel of claim 1 wherein the first layer is an interior layer and the second layer is an exterior layer.

3. The article of apparel of claim 2 wherein at least one of the interior layer and the exterior layer is a textile layer.

4. The article of apparel of claim 3 wherein the textile layer is provided by a four way stretch material.

5. The article of apparel of claim 3 wherein the bonding layer is provided by an adhesive material.

6. The article of apparel of claim 5 wherein the adhesive material is at least partially embedded in the textile layer.

7. The article of apparel of claim 1 wherein the article of apparel is an article of footwear.

8. The article of apparel of claim 1 wherein the perimeter walls of the auxetic structure comprise a plurality of interconnected wall segments that form a repeating pattern of reentrant polygonal shapes.

9. The article of apparel of claim 1 wherein the auxetic structure has a Poisson's ratio of substantially zero or less than zero.

10. The article of apparel of claim 1 wherein the bonding layer is a printed layer.

11. The article of apparel of claim 1 wherein the exterior layer is provided by a sheer material and the bonding layer is visible through the sheer material.

12. An article of apparel comprising:

a first layer defining a first surface;

an auxetic structure penetrating the first surface of the first layer, the auxetic structure including a plurality of interconnected members forming an array of cell units, each of the plurality of interconnected members forming cell walls with interior recesses defined within the cell walls, the cell walls forming a repeating pattern of reentrant polygonal shapes; and a second layer coupled to the first layer via the auxetic structure.

13. The article of apparel of claim 12 wherein the auxetic structure further penetrates the second layer.

14. The article of apparel of claim 12 wherein the auxetic structure is an adhesive material printed on the first layer.

15. The article of apparel of claim 12 wherein the first layer is a four-way stretch material and the second layer is a leather material or a synthetic leather material.

16. The article of apparel of claim 12 wherein the article of apparel is an article of footwear.

17. An article of apparel including a textile laminate comprising:

an interior layer possessing an interior layer Poisson's value;

an exterior layer possessing an exterior layer Poisson's value; and a bonding layer positioned between the interior layer and the exterior layer, the bonding layer forming an auxetic structure defining a repeating pattern of perimeter walls and interior recesses, wherein the bonding layer is at least partially embedded in the interior layer and the exterior layer, and wherein the textile laminate possesses a laminate Poisson's value that is less than at least one of the interior layer Poisson's value and the exterior layer Poisson's value.

18. The article of apparel of claim 17 wherein at least one of the interior layer and the exterior layer is a textile layer, and wherein each of the interior layer Poisson's value and the exterior layer Poisson's value is a positive value.

19. The article of apparel of claim 18 wherein the interior layer is a resilient textile provided by a four way stretch material possessing stretch and recovery properties.

20. The article of apparel of claim 17 wherein the perimeter walls of the auxetic structure comprise a plurality of interconnected wall segments that form a repeating pattern of reentrant polygonal shapes.

* * * * *